United States Patent [19]

Maeda et al.

[11] 4,434,646

[45] Mar. 6, 1984

[54] C-FRAME PRESS

[75] Inventors: Nobuyoshi Maeda; Hideo Itakura; Takashi Yagi, all of Sagamihara, Japan

[73] Assignee: Aida Engineering, Ltd., Sagamihara, Japan

[21] Appl. No.: 390,625

[22] Filed: Jun. 21, 1982

[30] Foreign Application Priority Data

Dec. 17, 1981 [JP] Japan ..... 56-202535

[51] Int. Cl.[3] ..... B21J 9/18

[52] U.S. Cl. ..... 72/451; 72/455; 100/231

[58] Field of Search ..... 72/451, 455; 100/214, 100/231, 272

[56] References Cited

U.S. PATENT DOCUMENTS

| | | | |
|---|---|---|---|
| 2,054,428 | 9/1936 | Klocke | 72/451 |
| 2,784,665 | 3/1957 | Georgeff | 100/272 |
| 3,124,019 | 3/1964 | Chatfield | 72/456 |
| 3,581,656 | 6/1971 | Pappas | 100/214 |
| 3,662,640 | 5/1972 | Wrona | 100/231 |

FOREIGN PATENT DOCUMENTS

| | | | |
|---|---|---|---|
| 2234224 | 1/1974 | Fed. Rep. of Germany | 100/214 |

*Primary Examiner*—Gene P. Crosby

*Attorney, Agent, or Firm*—Wenderoth, Lind & Ponack

[57] ABSTRACT

A C-frame press includes a C-shaped frame having a crown part and a bed part defining an opening therebetween, and spacers positioned in the opening and being sufficiently long for urging the crown part and the bed part apart in the vertical direction a distance sufficient to cause the frame to exert on the spacers a load which is at least a substantial part of the normal maximum press load exerted by the press on a workpiece. The press further has a slide reciprocal between the crown part and the bed part, a main shaft having a flywheel thereon and positioned laterally of the slide within the frame, eccentric discs rotatably mounted within the frame and driven from the main shaft, connecting rods extending substantially horizontally from the eccentric discs towards the upper portion of the slide and reciprocated by the eccentric discs, and a toggle mechanism mounted between the slide and the crown part and having a central shaft portion to which the connecting rods are connected.

1 Claim, 8 Drawing Figures

C-FRAME PRESS

BACKGROUND OF THE INVENTION AND PRIOR ART

The present invention relates to a press in which the press frame is C-shaped and the slide is driven by a toggle mechanism, and which press is particularly suitable for cold forging.

Recently, processing by cold forging has been increasing because it is superior in productivity and stock utilization to cut and chip processing. Further, progress in methods of cold forging as well as quality and durability of dies has been remarkable, and there is an increasing tendency to utilize cold forging for processing materials which have heretofore been processed by cut and chip processing only. It would therefore be desirable to have improved forging presses.

Because a C-frame press is open at the front, it has an advantage over a straight-side press for convenience of operation. However, it has a shortcoming that it is liable to be deformed by the operational load. This deformation can be divided into two parts: one is deformation due to the horizontal component of the load, and it upsets the alignment between the punch and the die which has been set before operation, and changes the pre-adjusted correct clearance between them. This type of deformation thus has bad effects on both the operational precision and the durability of the dies. The other type of deformation is that due to the vertical component, and it acts to increase the distance between the punch and die, the so-called "open mouth" phenomenon. This deformation caused the punch to push very abruptly into the die due to the resilience or restoring force of the frame and other parts as soon as the operational pressure is no longer exerted on the punch during a blanking operation, i.e. as soon as the actual blanking operation is over although the punch is still in the material. This phenomenon is called "break-through", and it has a considerable effect on the durability of the dies.

As one measure to prevent the "open-mouth"-phenomenon, it has heretofore been proposed to use tie rods across the opening of the frame. By this measure the opening of the frame is opposed by the tie rods secured by screws to the crown and bed parts of the press so that the frame is pre-deflected in a direction opposite to that of widening of the opening. However, because the frame is deflected in the direction to effect a "close mouth" phenomenon, excessive tightening causes considerable adverse deformation in this direction. Thus tie rods are not sufficient as a means to prevent the "open-mouth" phenomenon.

A toggle joint press travels speedily during the preliminary strokes, i.e. before the upper die mounted on the slide reaches the work piece, and its speed decreases during the actual working stroke so that it carries out the pressure-forming action at a slow speed. Thus, in a toggle joint press, as in a crank press, rotation of the motor is suitably decelerated, at the output thereof is changed into reciprocating movements through a crank and a connection, and a toggle mechanism causes the slide to carry out rectilinear compression forming.

Because in this type of press a large pressing power is obtained in the vicinity of the bottom dead center of the crank, it is suitable for forging.

OBJECTS AND BRIEF SUMMARY OF THE INVENTION

The object of the present invention is to minimize the "open-mouth" tendency in a C-frame press by providing spacers in the opening of the frame.

Another object of the present invention is to provide a C-frame press in which the slide is effectively driven by a toggle mechanism.

Still another object of the present invention is to provide a C-frame press in which the operational precision of the press is improved and durability of dies is increased while the operational merits which are the advantages of a C-frame press are retained.

These objects are achieved according to the present invention by the provision of a C-frame press comprising: a C-shaped frame having a crown part and a bed part defining an opening therebetween; and spacers positioned in said opening and being sufficiently long for urging said crown part and said bed part apart in the vertical direction a distance sufficient to cause said frame to exert on said spacers a load which is at least a substantial part of the normal maximum press load exerted by said press on a workpiece. The press further comprises a slide reciprocal between said crown part and said bed part, a main shaft having a flywheel thereon and positioned laterally of said slide within said frame, eccentric discs rotatably mounted within said frame and driven from said main shaft, connecting rods extending substantially horizontally from said eccentric discs towards the upper portion of said slide and reciprocated by said eccentric discs, and a toggle mechanism mounted between said slide and said crown part and having a central shaft portion to which said connecting rods are connected.

DETAILED DESCRIPTION OF THE INVENTION

Figure 1A:
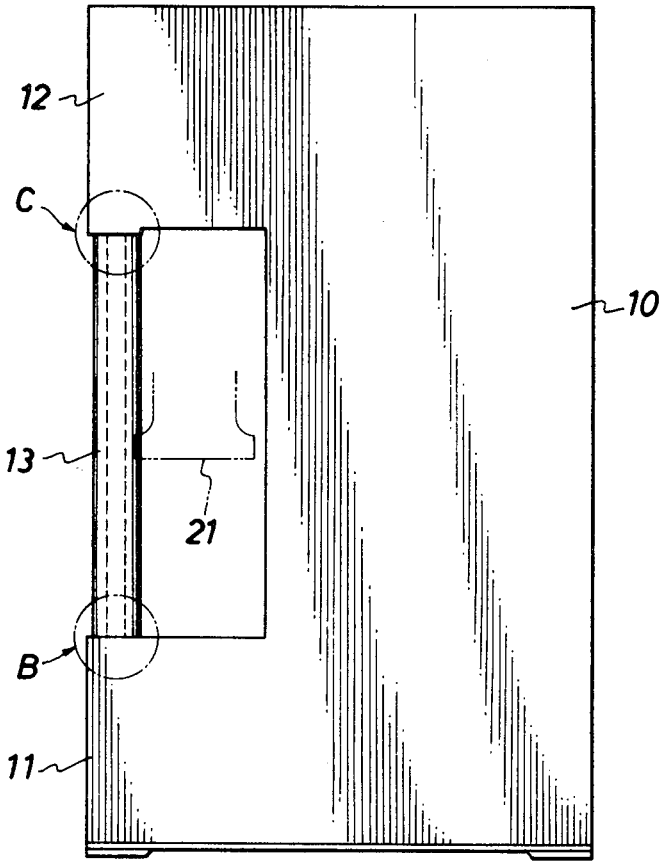
FIG. 1A is a side view of the press of the present invention.

The present invention will now be described in detail by way of a preferred embodiment as shown in the drawings.

Figure 1B:
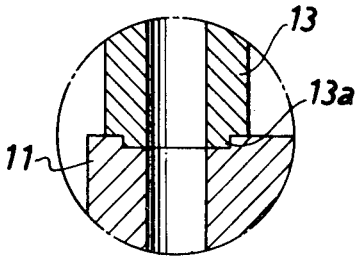
FIG. 1B and 1C are detailed sectional views on an enlarged scale, of the areas "B" and "C" of FIG. 1A respectively.
Figure 1C:
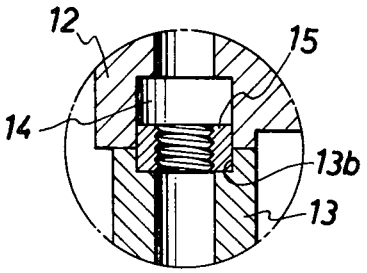
Figure 2:
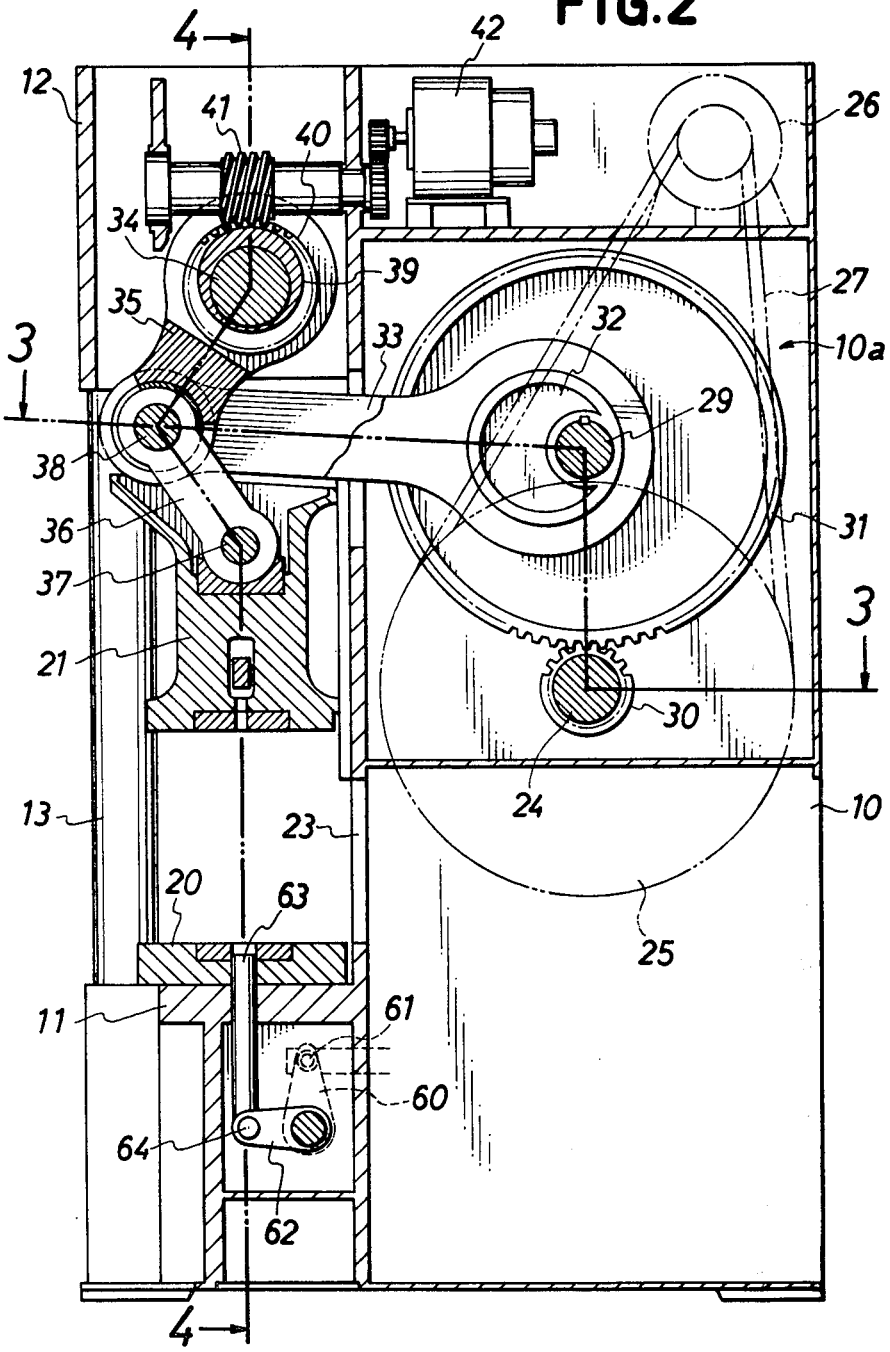
FIG. 2 is a vertical section through the operating part of the press of FIG. 1A.
Figure 3:
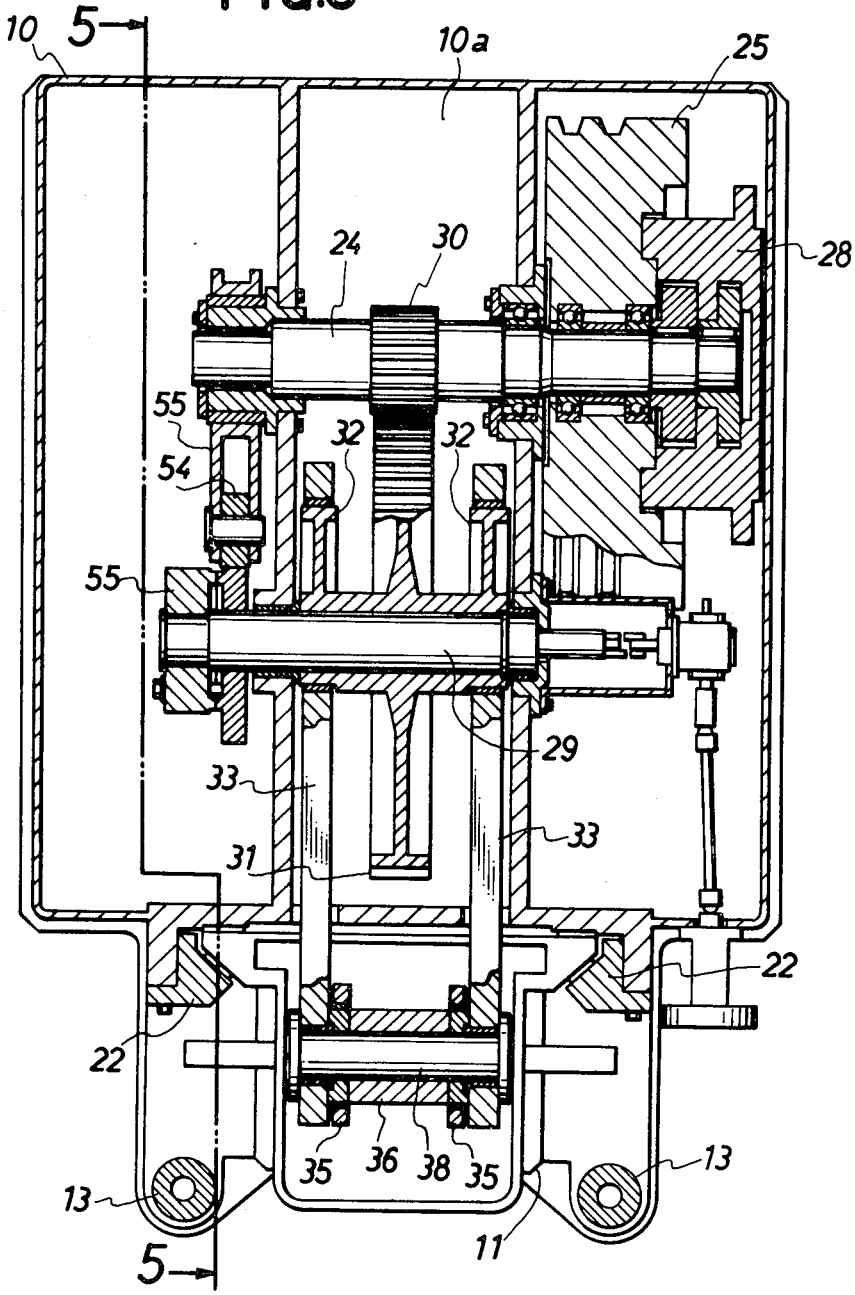
FIG. 3 is a cross-section taken along the lines 3—3 of FIG. 2.

FIGS. 1A–1C show a frame 10 of the press which when seen from the side is C-shaped. The press is the type in which the opening is defined by a bed 11 and a crown 12. In the end corners of the bed 11 and the crown 12 are mounted hollow spacers 13 which are slightly longer than the length of the opening. The spacers 13 are forcibly inserted into the opening in a direction parallel to the longitudinal direction of the frame. Because a load which amounts to 1.3–1.5 times the capacity of the press is exerted when the spacers 13 are mounted on the frame, there is no possibility that the spacers will fall out during a pressing operation. However, in order to further ensure the proper mounting of the spacers, the bottom ends of the spacers 13 have reduced diameter annular projecting portions 13*a* which fit in concave recesses in the bed 11, while upper ends have an annular recess therein as shown at 13*b*, cotters 15 being inserted in concave recesses 14 in the crown 12 and the recesses in the spacers 13.

Because the frame 10 is expanded with a load of 1.3–1.5 times the capacity of the press, i.e. the normal maximum load capable of being exerted by the press on a workpiece, the spacers 13 are compressed by the restoring force of the frame when the press stops operation. However, despite this, the frame is still maintained in the condition in which it is loaded in the expanding direction when the press is not in operation.

Figure 6:
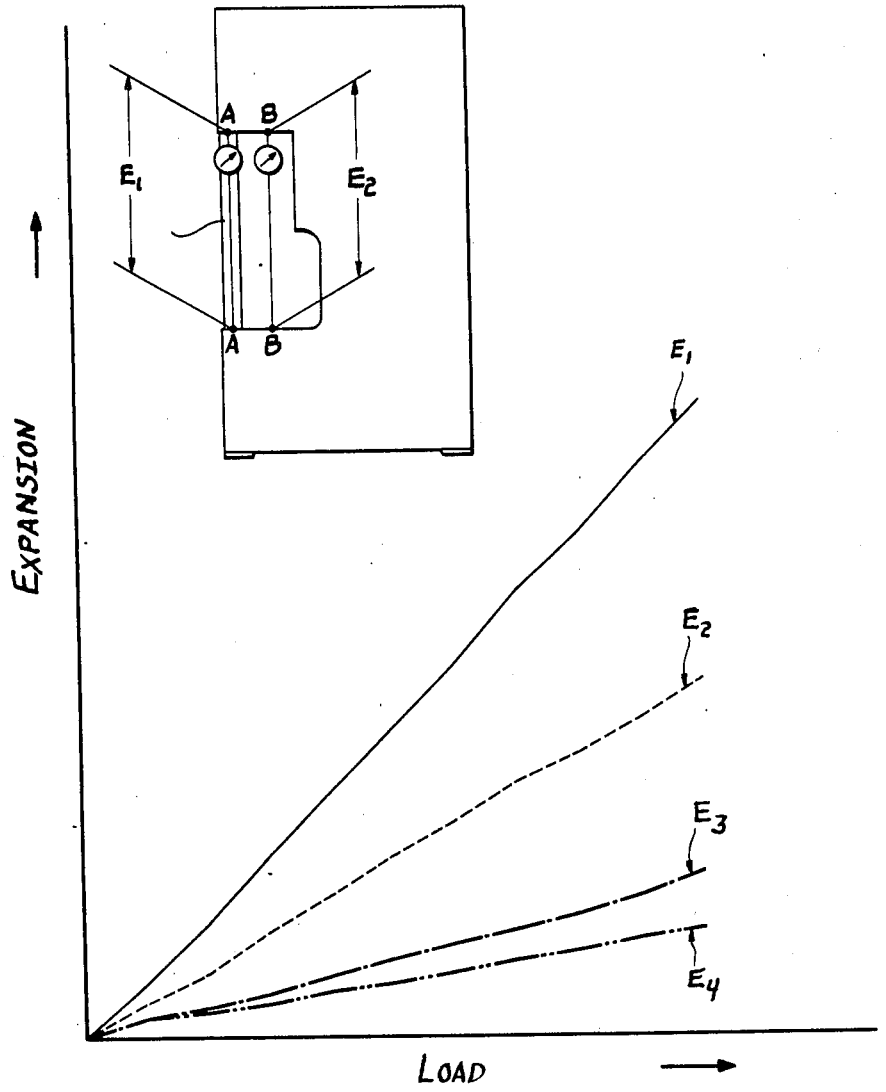
FIG. 6 is a diagram showing the relationship between the operational load and amount of frame deformation before and after mounting of spacers in the opening of the frame.

FIG. 6 shows the frame expansion before and after mounting of the spacers in the frame opening. The horizontal axis is the load while the vertical line is the amount of expansion of the frame. When no spacers are provided, the amount of expansion with respect to the load is larger than when they are provided. Simultaneously, the difference in amount of expansion $E_1$ between points A which are located near the end of the frame opening and expansion $E_2$ between points B which lie on the axis of the slide, tends to be larger. As a result of this, the operational defect described above is caused.

On the other hand, when the spacers are provided, the expansion of the frame is less, and as there is little difference in the amount of expansion $E_3$ and $E_4$ between points A and points B, respectively even when the operational load is increased, co-operation of the punch and die as well as the correct clearance between them are not disturbed, making possible operations which require precision, such as cold forging, in the C-frame press.

In the above-described C-frame press the slide or ram is driven by a toggle mechanism. A bolster 20 is fixed to the bed 11 of the frame 10 and at the position opposite the bolster a slide 21 is movably mounted in guides 22 for movement in the vertical direction, the guides 22 being mounted on the frame. The mechanism referred to above for driving the slide 21 is housed in a machine chamber 10*a* at the back of the frame 10. In the chamber the principal compartment is in the upper position so that removal of products and inspection of the machine can be easily performed by utilizing an opening 23 provided at the rear of the bolster and the lower part of the chamber.

A drive shaft 24 extend through the machine chamber 10*a*, and a flywheel 25 mounted on the drive shafts 24 is driven by a belt 27 connected to a main motor 26. A clutch brake device 28 is provided between the shaft 24 and the flywheel 25, and it is operated by pressed air supplied from an air supply mechanism not shown.

A main shaft 29 also extends through chamber 10*a* parallel to the drive shaft 24, and the rotation of the shaft 24 is transmitted to the shaft 29 by a pinion 30 on the shaft 24 and a gear 31 provided on the shaft 29. Two eccentric discs 32 are mounted on the shaft 29 on opposite sides of the gear 31, and connecting rods 33 are freely rotatably mounted on each of the discs 32 and project from the machine chamber 10*a* and face the upper part of the slide 21.

A support shaft 34 is fixed to the crown 12 of the frame 10 and extends in a direction parallel to the main shaft 29. The upper link 35 is rotatably mounted on the support shaft 34, and a lower link 36 is pivotally connected to the slide 21 by a connecting shaft 37. The two links 35 and 36 are connected in a toggle by a shaft 38 to which, in turn, is connected the connecting rods 33. When the eccentric discs 32, are rotated by the rotation of the main shaft 29, the connecting rods 33 reciprocate longitudinally and the slide 21 is moved up and down by the movement of the toggle mechanism constituted by the upper and lower links 35 and 36.

Figure 4:
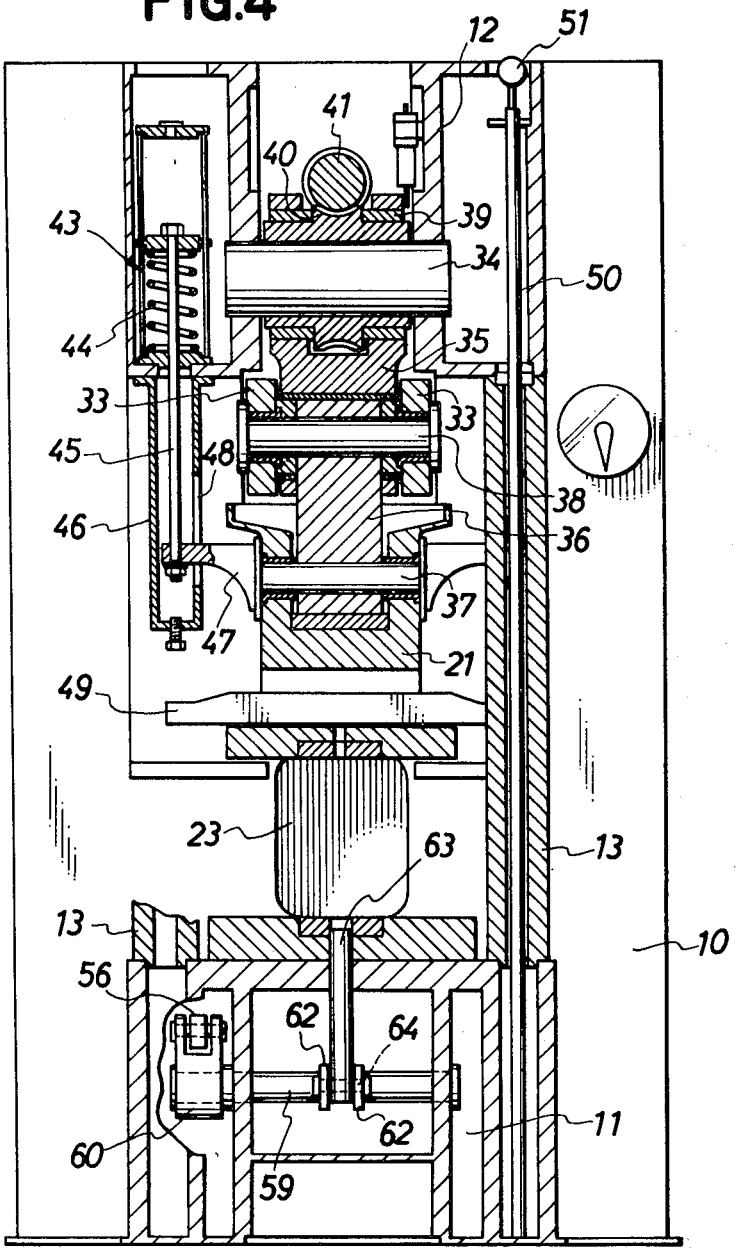
FIG. 4 is a cross-section taken along the line 4—4 of FIG. 2.

A worm wheel 39 is mounted between the support shaft 34 and the upper link 35, the eccentric parts 40 which are integral with the worm wheel 39, are connected to the upper link 35. The worm wheel 39 is concentric with the support wheel 34. A worm 41 mounted on the crown 11 engages with the worm wheel 39, and it is rotated by a motor 42 provided on the frame 10 so that the position of the fulcurm of the upper link 35 can be adjusted by the rotation of the worm 41 driving the eccentric parts 40, thereby adjusting the position of the slide 21 at the bottom dead center. Referring to FIG. 4, balancers 43 which press the slide 21 upward are provided on both sides of the slide. In the drawing, only the balancer on the left-hand side is shown. Each balancer 43 comprises a balancer rod 45 which is pressed upward by a spring 44 and which is housed in a hollow knockout rod 46 mounted on the frame. An attachment plate 47 on the slide 21 is connected to the balancer rod 45 through a slot 48 which extends in the longitudinal direction of the knockout rod 46.

The balancer rod 45 does not interfere with a knockout bar 49 which corresponds to the knockout rod 46, and maintains an ideal position with respect to the bar 49 and the knockout rod keeps the operator away from the danger of the balancer rod 45 which moves up and down with the slide.

A load detecting device is provided which extends through the hollow interior of one of the spacers provided in the opening of the frame. The load detecting device comprises a detecting rod 50 extending through the frame 10 and one spacer 13, with the lower end secured to the frame and the upper end being in contact with a feeler of a load meter 51. This meter is positioned to detect a change of position of the upper part of the frame with respect to the upper end of the detecting rod 50, i.e. the amount of expansion of the frame when a load is exerted on the slide 21.

Figure 5:
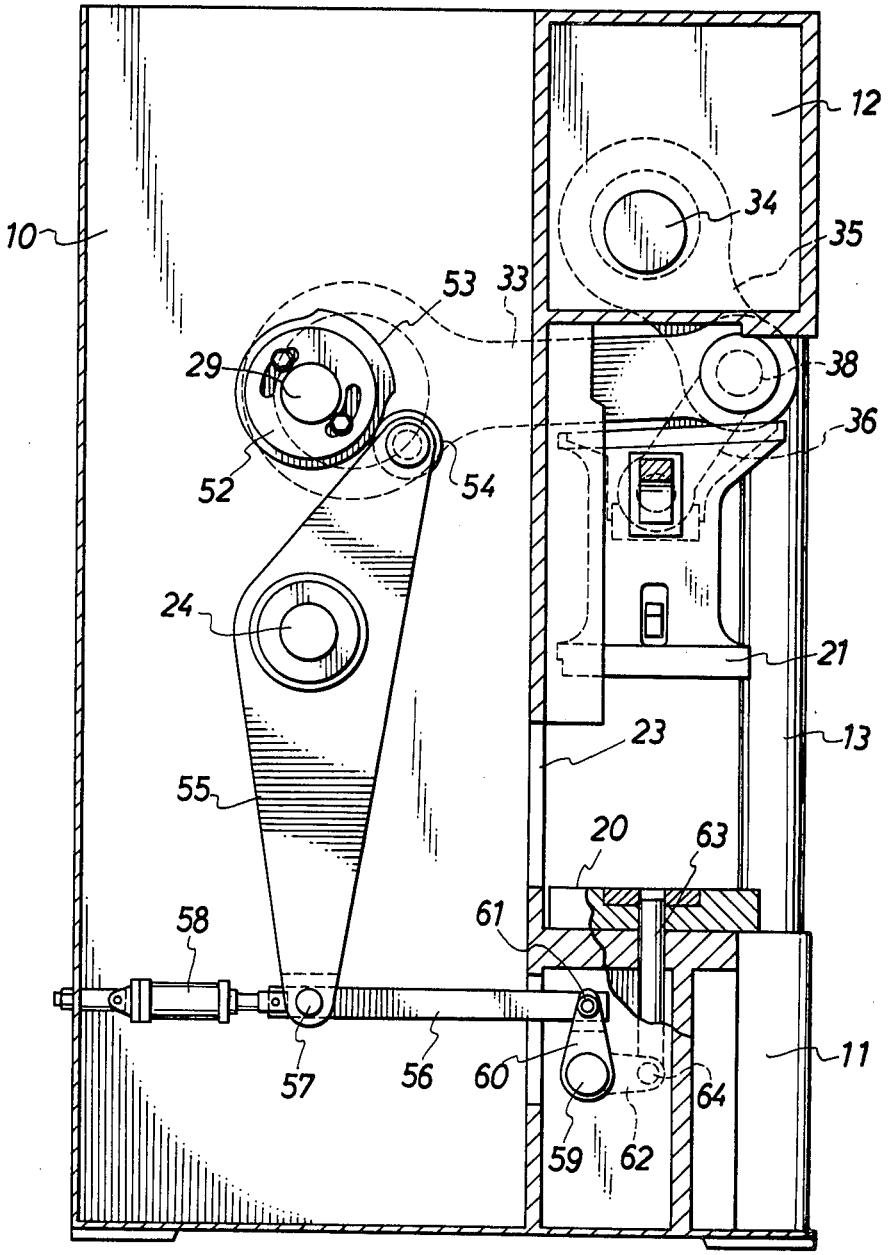
FIG. 5 is a cross-sectional taken along the line 5—5 of FIG. 3 and which is partly broken away at the center of the bolster.

A die knockout device is also incorporated in the press of the present invention. As seen best in FIG. 5, a holder 52 is fixed at one end of the main shaft 29, and a cam 53 is provided on the holder in a manner such that its mounting position may be freely changed. A lever 55 with a cam follower 54 thereon which engages the cam 53, is rotatably mounted on the drive shaft 24. The opposite end of the lever 55 from the cam follower 54 extends downward in the frame 10 and is connected by a pin 57 to a link 56, one end of which faces the lower part of the bed 11.

The other end of the link 56 is connected to a pneumatic cylinder 58 mounted on the frame, and the one end is connected by a pin 61 to an arm 60 which is fixed to a shaft 59 rotatably mounted on the frame 10. Another arm 62 is fixed to the shaft 59, and a knockout pin 63 is connected to the arm 62 by a pin 64. In timed relationship with the rotation of the main shaft 24, the knockout pin 63 moves up and down with respect to the dies provided in the bolster 20 so as to knock the products out of the dies.

In the press of the present invention, constructed as described above, the position of the bottom dead center of the slide 21 is set by driving the motor 42. A press operation is performed by rotating the flywheel 25 by the main motor 26, and upon occurrence of the signal indicating the start of the operation, transmitting the rotation of the pinion 30, gear 31 and eccentric discs 32 through the clutch device 28. This causes swinging of the connecting rods 33 by the discs 32, and finally movement of the slide up and down by the toggle mechanism formed by the upper and lower links 35 and 36.

Because the frame is strengthened to minimize the widening of the opening and at the same time the slide is driven by a toggle mechanism, the present press is suitable for cold forging and blanking etc., while fully retained excellent operational ability which is characterized of a C-frame press.

What is claimed is:

1. A C-frame press comprising:

a C-shaped frame having a crown part and a bed part defining an opening therebetween, a slide reciprocal between said crown part and said bed part, a main shaft having a flywheel thereon and positioned laterally of said slide within said frame, eccentric discs rotatably mounted within said frame and driven from said main shaft, connecting rods extending substantially horizontally from said eccentric discs towards the upper portion of said slide and reciprocated by said eccentric discs, and a toggle mechanism mounted between said slide and said crown part and having a central shaft portion to which said connecting rods are connected, said frame having a machine chamber within said frame adjacent said toggle mechanism and in which said main shaft, eccentric discs and connecting rods are located, said space within said frame adjacent the bed part being clear for receiving part of the workpiece being acted on by said press; and spacers positioned in said opening in said C-shaped frame and being sufficiently long for urging said crown part and said bed part apart in the vertical direction a distance sufficient to cause said frame to exert on said spacers a load which is at least a substantial part of the normal maximum press load exerted by said press on a workpiece.

* * * * *